US006050634A

United States Patent [19]

Yamagishi et al.

[11] Patent Number: 6,050,634

[45] Date of Patent: Apr. 18, 2000

[54] DEVICE FOR ADJUSTING HEIGHT OF AN ARMREST FOR CHAIR

[75] Inventors: Hideyuki Yamagishi; Masayuki Ozawa; Naokuni Nakata; Kohichi Ogura, all of Iruma, Japan

[73] Assignee: Plus Corporation, Tokyo, Japan

[21] Appl. No.: 09/175,289

[22] Filed: Oct. 20, 1998

[30] Foreign Application Priority Data

Feb. 13, 1998 [JP] Japan ..... 10-030782

[51] Int. Cl.[7] ..... A47C 7/54

[52] U.S. Cl. ..... 297/115; 297/411.36; 297/353

[58] Field of Search ..... 297/411.36, 353, 297/410, 115; 248/118, 118.3

[56] References Cited

U.S. PATENT DOCUMENTS

| | | | |
|---|---|---|---|
| 4,660,885 | 4/1987 | Suhr et al. | 297/353 |
| 5,265,938 | 11/1993 | Melhuish et al. | 297/411.36 |
| 5,382,079 | 1/1995 | Wilson et al. | 297/411.36 |
| 5,647,638 | 7/1997 | Ritt et al. | 297/411.36 |
| 5,664,842 | 9/1997 | Tseng | 297/411.36 |
| 5,695,249 | 12/1997 | Lotfi | 297/353 |

*Primary Examiner*—Peter M. Cuomo
*Assistant Examiner*—Stephen Vu
*Attorney, Agent, or Firm*—Darby & Darby

[57] ABSTRACT

A device for adjusting the height an armrest of a chair including a support disposed on a chair and a receiving/supporting cylinder movably engaged with a support. Extending longitudinally in a slit in the receiving/supporting cylinder is a stepped member. An engaging piece within the cylinder is adapted to be moved into and out of engagement with the stepped member. The engaging piece extends through a slit in the cylinder. Surrounding the receiving/supporting cylinder is an operating cylinder which has circumferentially spaced internal ridges. As the operating cylinder is rotated. the ridges engage the engaging piece and move it into and out of contact with the stepped member.

A spiral circumferential groove is also provided in the receiving/supporting cylinder and a pin on the operating cylinder is engaged in the spiral groove whereby rotatable movement of the operating cylinder causes axial movement of the same. Tapered edges are provided on the operating cylinder and a member connected to the receiving/supporting cylinder so that as the operating cylinder is raised and lowered, the member is clamped and unclamped to the support.

4 Claims, 6 Drawing Sheets

DEVICE FOR ADJUSTING HEIGHT OF AN ARMREST FOR CHAIR

BACKGROUND OF THE INVENTION

1. Field of the Invention

The present invention relates to a device for adjusting height of an armrest for an office chair.

2. Prior Art

There has been proposed a device for adjusting height of an armrest for a chair, e.g. by Japanese Patent Application No. 9-234134, which comprises a hollow support, a longitudinally extending adjusting slit disposed on the support, receiving/supporting portions longitudinally disposed at the adjusting slit, a longitudinally extending receiving/supporting cylinder for use in an armrest, an operating lever swingably mounted on the receiving/supporting cylinder, and a pin disposed on a distal end of the operating lever, and selectively engaged with the receiving/supporting portion.

According to the prior art, the operation of adjusting the height of the armrest is carried out by engaging the operating lever with a notch (slit) disposed on the receiving/supporting cylinder, and pressing the operating lever protruding from the notch toward the support; thereby causing the operating lever to necessarily partially protrude from the receiving/supporting cylinder, which provides problems related to an exterior view and a decency of the device. Further, the height of the armrest is held using an urging force of a plate spring against the operating lever, which provides disadvantages that the function of holding the height of the armrest is lowered with the aged deterioration of the plate spring, and that the height of the armrest is difficult to be held when the plate spring receives a force stronger than its resilient force from above.

SUMMARY OF THE INVENTION

The present invention has been made in view of the above-mentioned conventional disadvantages; therefore it is an object of the invention to provide a device for adjusting height of an armrest for a chair, which has a good exterior view and a good decency, and is capable of surely holding height of an armrest for a chair.

To attain the above object, according to a first aspect of the invention, there is provided a device for adjusting height of an armrest for a chair, comprising:

a support uprightly disposed on a seat;

a receiving/supporting cylinder for use in an armrest, longitudinally movably engaged with the support, with the support inside;

a longitudinally extending slit disposed on the receiving/supporting cylinder;

an engaging piece integrally disposed on the receiving/supporting cylinder at longitudinal direction-wise one end of the slit, and being elastically deformable inside the slit to thereby swing;

a longitudinal groove disposed on the support;

catching pieces disposed longitudinally in a steps-manner on a bottom wall of the groove, for catching a distal end portion of the engaging piece by stages;

an operating cylinder disposed outside the receiving/supporting cylinder, and rotatably engaged with the receiving/supporting cylinder;

a pin protrudingly disposed on one of an inner circumferential surface of the operating cylinder and an outer circumferential surface of the receiving/supporting cylinder;

a circumferential direction-wise extending guiding groove disposed on the other of the inner circumferential surface of the operating cylinder and the outer circumferential surface of the receiving/supporting cylinder; and a longitudinally extending ridge disposed on the inner circumferential surface of the operating cylinder, for forcedly pressing the distal end portion of the engaging piece toward the receiving/supporting cylinder when the pin is moved along the guiding groove from one end of the guiding groove to the other.

According to a second aspect of the invention, there is provided a device for adjusting height of an armrest for a chair, comprising:

a support uprightly disposed on a seat;

a receiving/supporting cylinder for use in an armrest, longitudinally movably engaged with the support, with the support inside;

a longitudinally extending slit disposed on the receiving/supporting cylinder;

an engaging piece integrally disposed on the receiving/supporting cylinder at longitudinal direction-wise one end of the slit, and being elastically deformable inside the slit;

a longitudinal groove disposed on the support;

catching pieces disposed longitudinally in a steps-manner on a bottom wall of the groove, for catching a distal end portion of the engaging piece by stages;

an operating cylinder disposed outside the receiving/supporting cylinder, and rotatably engaged with the receiving/supporting cylinder;

a pin protrudingly disposed on one of an inner circumferential surface of the operating cylinder and an outer circumferential surface of the receiving/supporting cylinder;

a circumferential direction-wise extending guiding groove disposed on the other of the inner circumferential surface of the operating cylinder and the outer circumferential surface of the receiving/supporting cylinder; and a longitudinally extending ridge disposed on the inner circumferential surface of the operating cylinder, for contacting to the distal end portion of the engaging piece to thereby prevent the engaging piece from being elastically deformed in the direction away from the catching pieces when the pin is moved along the guiding groove from one end of the guiding groove to the other.

In a preferred embodiment of the invention, a lower portion of the receiving/supporting cylinder is constructed by an elastically deformable cylinder piece which is provided with silts, each opening downward, arranged along the circumferential direction, an outer circumferential surface of a lower portion of the cylinder piece and an inner circumferential surface of a lower portion of the operating cylinder are provided with tapered edges which are complementary to each other, respectively, and the tapered edge of the operating cylinder is interface fit to the tapered edge of the cylinder piece when the pin is moved along the guiding groove from the one end to the other end which is located above the one end.

According to the invention, the receiving/supporting cylinder is received by the operating cylinder, which enables an exterior view and a decency of the device to be improved.

Further, the height of the armrest is kept by pressing the engaging piece by the operating cylinder, which prevents the keeping of the height of the armrest to be failed, even if the elasticity of the engaging piece is deteriorated.

According to the preferred embodiment of the invention, the height of the armrest can be further surely kept.

The above and other objects, features, and advantages of the invention will be more apparent from the following detailed description taken in conjunction with the accompanying drawings.

DETAILED DESCRIPTION OF THE PREFERRED EMBODIMENTS

Figure 1:
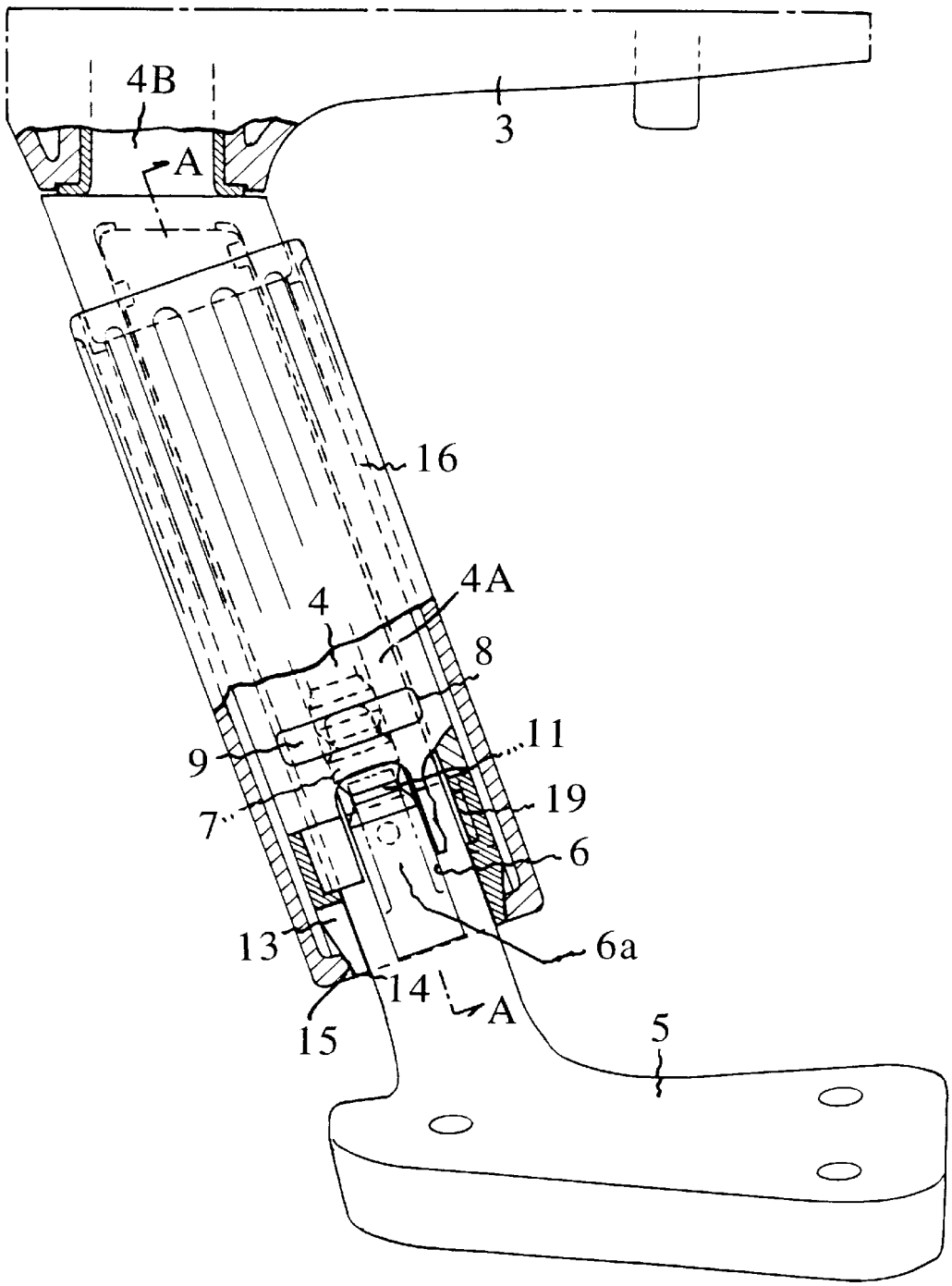
FIG. 1 is a partially cutaway front view of a main part of a first embodiment of the invention.
Figure 2:
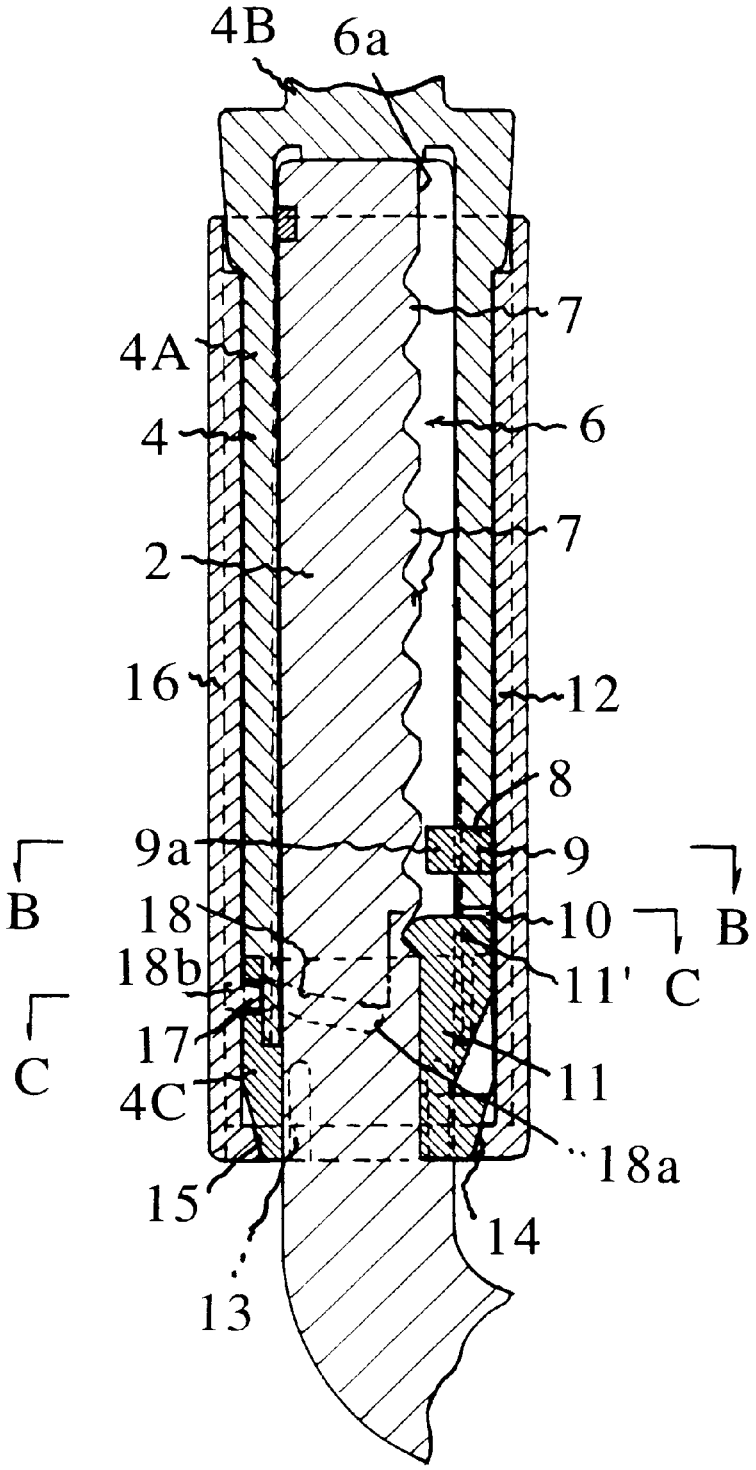
FIG. 2 is a sectional view taken on line A—A in FIG. 1.
Figure 3:
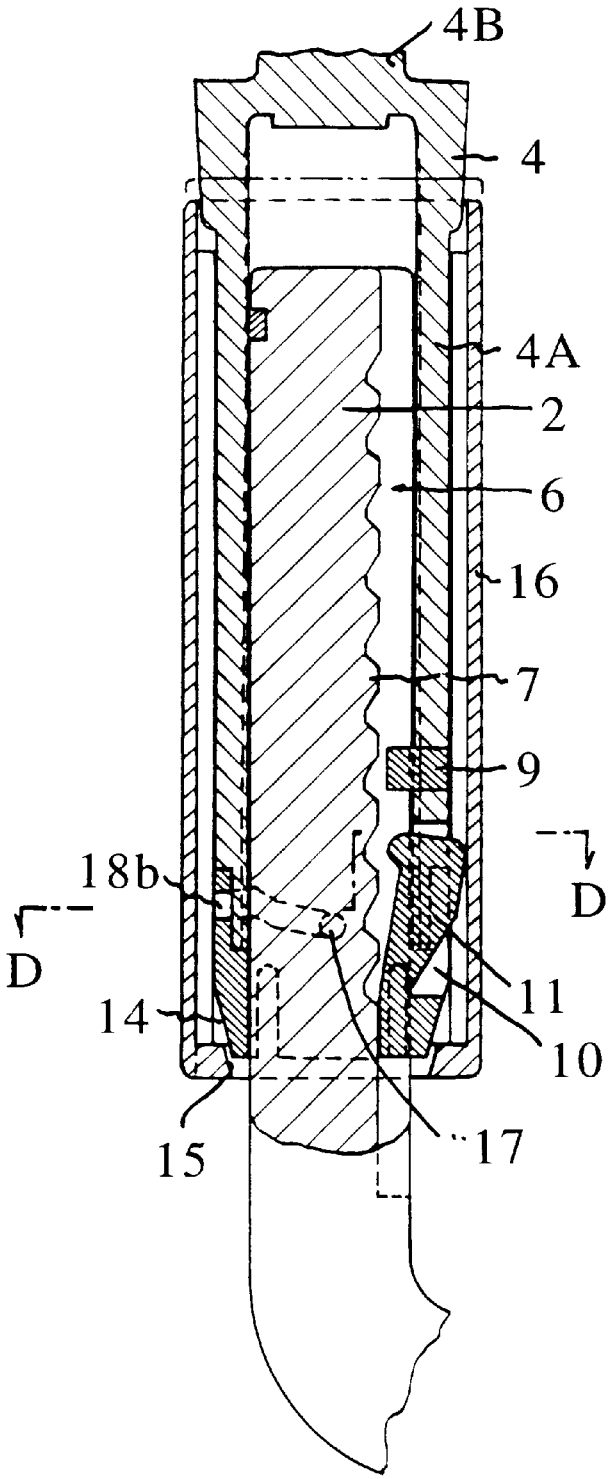
FIG. 3 is a sectional view of the first embodiment of the invention when an armrest moves longitudinally.
Figure 4:
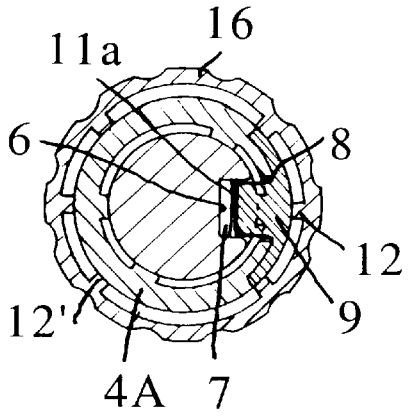
FIG. 4 is a sectional view taken on line B—B in FIG. 2.
Figure 5:
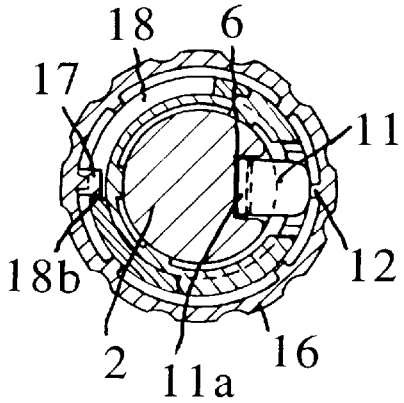
FIG. 5 is a sectional view taken on line C—C in FIG. 2.
Figure 6:
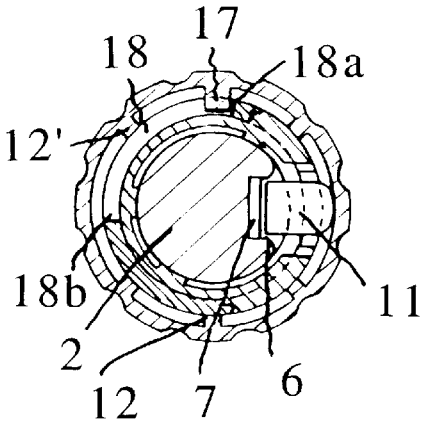
FIG. 6 is a sectional view taken on line D—D in FIG. 3.
Figure 7:
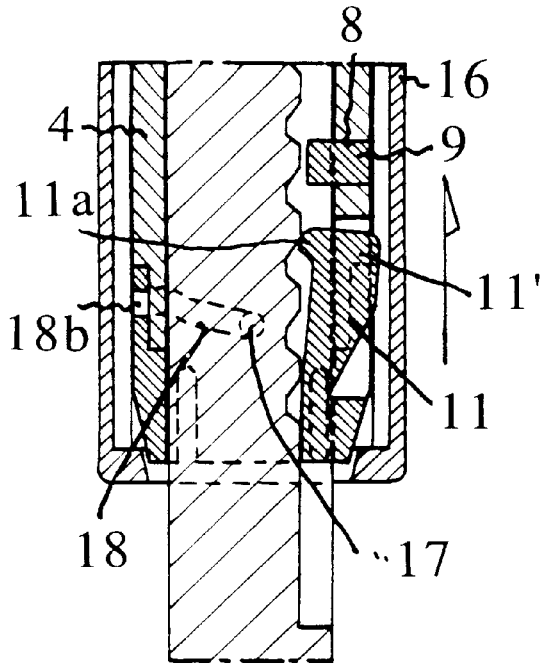
FIG. 7 is a sectional view of a second embodiment of the invention when an armrest moves longitudinally.
Figure 8:
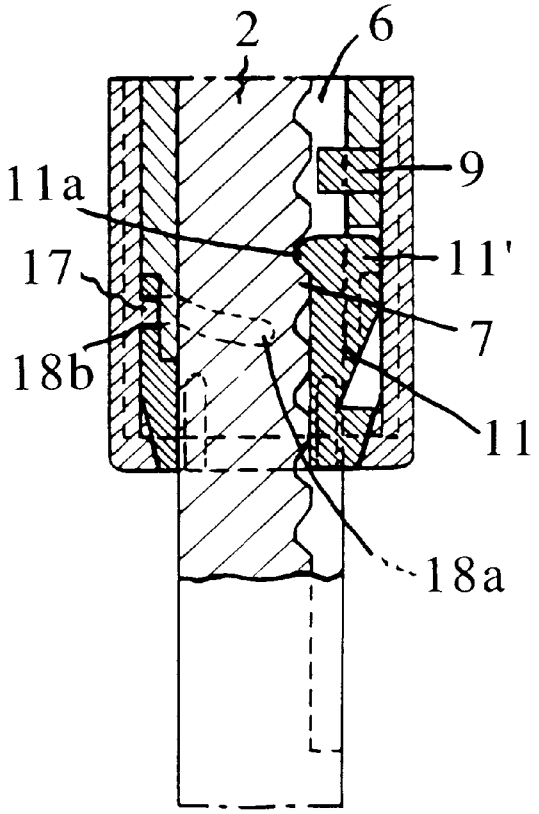
FIG. 8 is a sectional view of the second embodiment when the armrest is in a set position.

The inventions will now be described in detail with reference to the drawings showing a device for adjusting height of an armrest for a chair according to embodiments of the invention. FIG. 1 is a partially cutaway front view of a first embodiment of the invention; FIG. 2 is a sectional view taken on line A—A in FIG. 1; FIG. 3 is a sectional view of the first embodiment of the invention when an arm rest moves longitudinally; FIG. 4 is a sectional view taken on line B—B in FIG. 2; FIG. 5 is a sectional view taken on line C—C in FIG. 2; FIG. 6 is a sectional view taken on line D—D in FIG. 3; FIG. 7 is a sectional view of a second embodiment of the invention when an armrest moves longitudinally; FIG. 8 is a sectional view of the second embodiment when the armrest is in a set position; and FIG. 9 is a front view of an office chair.

Figure 9:
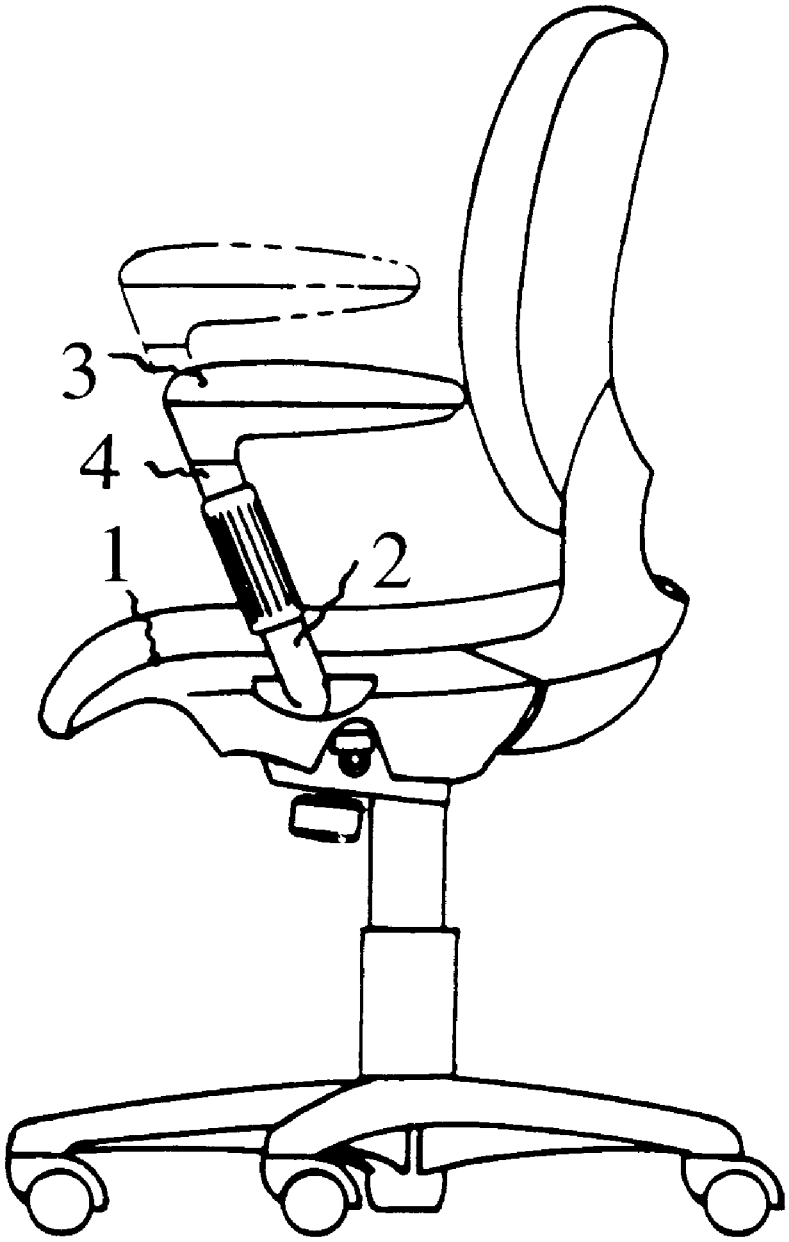
FIG. 9 is a first view of an office chair.

In FIG. 9, an office chair comprises a seat 1, a support 2 of a circle cross-section uprightly disposed on the seat 1, an armrest 3, a receiving/supporting cylinder 4 for receiving the support 2 and supporting armrest 3. The receiving/supporting cylinder 4 is moved longitudinally so as to be located at a suitable height, which enables the height of the armrest 3 to be adjusted. The support 2 has an attachment piece 5 at a lower end thereof, and hence the attachment piece 5 is fixed to the seat 1. The support 2 has a longitudinal groove 6 at a circumferential surface thereof, and hence the longitudinal groove 6 has a suitable number of catching pieces 7 at a bottom wall 6*a* thereof, which pieces 7 are arranged in steps-manner along the longitudinal direction.

The receiving/supporting cylinder 4 is combined with the support 2 from above with the support 2 inside so as to longitudinally move. The receiving/supporting cylinder 4 comprises a cylinder main body 4A having an opening at a lower end thereof, an attaching shaft 4B uprightly disposed on an upper surface of the cylinder main body 4A for attaching the armrest 3, and an elastic cylinder piece 4C, made of a synthetic resin, mounted on a lower end of the cylindrical main body 4A.

The cylinder main body 4A has a laterally extending slit 8 at a lower thereof, and then the slit 8 is attached with an attaching piece 9 having a protruding piece 9*a* at an inner surface thereof. This protruding piece 9*a* is engaged with the longitudinal groove 6 disposed on the support 2 and then contacted to an edge portion of the longitudinal groove 6, which prevents the receiving/supporting cylinder 4 from rotating in a circumferential direction of the support 2.

The cylinder main body 4A has an upper side notch at a lower end thereof, and the cylinder piece 4C has a lower side notch. The upper side notch and the lower side notch constitute a longitudinally extending slit 10 in association with each other. The cylinder piece 4C is integrally provided with an engaging piece 11 at a lower end of the slit 10, which piece 11 is elastically deformed to swing (rotate) inside the slit 10. Moreover, if the cylinder main body 4A is made of an elastic material, the engaging piece 11 may be integrally disposed on the receiving/supporting cylinder 4 at an upper end of the slit 10.

The engaging piece 11 is made of the same material as that of the cylinder piece 4C, and then is positioned inside the slit 10 at an upper side distal end portion 11' thereof. When it receives no external force through the outer face (by a ridge 12 described later), the distal end portion 11' usually protrudes outward through an outer circumferential surface of the receiving/supporting cylinder 4, whereas when it receives the external force, the free end portion 11' is elastically deformed to swing toward an inner circumferential surface of the receiving/supporting cylinder 4, that is, toward the bottom wall 6*a* or the catching pieces 7, which causes an engaging protrusion 11*a* disposed on an inner surface of the distal end portion 11' to be engaged with the catching piece 7.

Further, the cylinder piece 4A has a series of slits 13 arranged in the circumferential direction at a lower end opening portion thereof, and has a tapered edge 14 at an outer circumferential surface of the lower end opening portion thereof. An operating cylinder 16 has a tapered edge 15, which is complementary to the tapered edge 14, at an inner circumferential surface of a lower end opening portion thereof.

The operating cylinder 16 is rotatably engaged with the receiving/supporting cylinder 4 with the receiving/supporting cylinder 4 inside, and then has a protruding pin 17 at an inner circumferential surface thereof. On the other hand, the receiving/supporting cylinder 4 has a circumferential direction-wise extending guiding groove 18 at an circumferential surface of a combined portion of the cylindrical main body 4A and the cylinder piece 4C, that is, the outer circumferential surface of the receiving/supporting cylinder 4. The operating cylinder 16 is combined with the receiving/supporting cylinder 4 with the pin 17 movably engaged with the guiding groove 18. Further, the operating cylinder 16 has the above-mentioned ridge 12 as well as ridges 12' which serve as spacers or centering members. Moreover, the operating portion 16 has a lower end opening portion which is smaller in diameter than the inner circumferential surface portions of the ridges 12, 12'. This lower end opening portion of the operating portion 16 has the above-mentioned tapered edge 15 at an inner circumferential surface portion thereof.

The guiding groove 18 is formed by closing a slit disposed on the cylinder piece 4C by the receiving/supporting cylinder 4 received inside the cylinder piece 4C, and is arranged in such a manner that its one end 18*a* is located below its other end 18*b*. Therefore, when the pin 17 is moved from the side of the one end 18*a* to the side of the other end 18*b*, the ridge 12 is engaged with an outer surface of the free end portion 11' of the engaging piece 11, which causes the engaging protrusion 11*a* of the free end portion 11' to be engaged with the catching piece 7.

Then, raising the armrest 3 causes the receiving/supporting cylinder 4 to be raised together with the operating cylinder 16 because of the engagement-relationship between the pin 17 and the guiding groove 18, and then rotating the operating cylinder 16 with its raising position maintained causes the movement of the operating cylinder 16 to be regulated in the direction in which the pin 17 is moved along the guiding groove 18. That is, as the pin 17 is moved and raised along the guiding groove 18 from the one end 18*a* to the other end 18*b*, the operating cylinder 16 is rotated and raised and the rotation of the receiving/supporting cylinder 4 is regulated. On this occasion, the tapered edge 15 of the operating cylinder 16 is slidably contacted to and hence pressure-contacted to the tapered edge 14 of the receiving/supporting cylinder 4 (cylinder piece 4C), thereby causing the receiving/supporting cylinder 4 to be diameter-reduced, which causes the support 2 to be interference fit. On the other hand, the engaging protrusion 11*a* of the engaging piece 11 is engaged with the catching piece 7 at the pertinent location, thereby causing the ridge 12 to be engaged with the engaging piece 11, which enables the raising position of the armrest 3 to be ensured. Thus, the armrest height adjusting operation is completed.

Further, when the operating cylinder 16 is rotation-urged in the initial position, the pin 17 is moved along the guiding groove 18 from the other end 18*b* to the one end 18*a*, thereby enabling the receiving/supporting cylinder 4 to be freely moved in the longitudinal direction, which enables the height adjustment to be changed to the next one.

Moreover, the pin 17 may be disposed on the receiving/supporting cylinder 4, and the guiding groove 18 may be disposed on the operating cylinder 16.

Furthermore, when the engaging protrusion 11*a* is surely engaged with the catching piece 7, the operation of the tapered edges 14 and 15 causes the support 2 to be fastened, which prevents the support 2 from chattering.

When the engaging protrusion 11*a* is surely engaged with the catching piece 7, the tapered edges 14 and 15 serve as a double stopper, or function of preventing the support 2 from chattering.

Moreover, in the first embodiment, the ridge 12 presses the free end portion 11' of the engaging piece 11, thereby causing the engaging protrusion 11*a* of the free end portion 11' to be located at the engaging location of the catching piece 7; however, in a second embodiment of the invention, an engaging protrusion 11*a* is, as shown in FIG. 7, usually located at the engaging location of said catching piece 7. In this embodiment, the ridge 12 is disposed on said operating cylinder 16, for regulating the displacement of the engaging protrusion 11*a* in the direction away from the catching piece due to the elastic deformation of the engaging piece 11, when the engaging protrusion 11*a* is moved to the engaging location of the next catching piece 7 as the receiving/supporting cylinder 4 is moved. That is, in the first embodiment, the elastic displacement of the engaging piece 11 causes the engagement of the engaging protrusion 11*a* a with the catching piece 7 to be maintained, whereas in the second embodiment, the above-mentioned displacement causes the engaging protrusion 11*a* to be disengaged with the catching piece 7.

What is claimed is:

1. A device for adjusting height of an armrest for a chair, said device comprising:

an upright support for attachment to a seat;

a receiving/supporting cylinder for use in an armrest, longitudinally movably engaged with said support, with said support inside;

a longitudinally extending slit disposed on said receiving/supporting cylinder;

an engaging piece integrally disposed on said receiving/supporting cylinder at longitudinal direction-wise one end of said slit, and being elastically deformable inside said slit to thereby swing;

a longitudinal groove disposed on said support;

catching pieces disposed longitudinally in spaced-apart steps on a bottom wall of said groove, for catching a distal end portion of said engaging piece;

an operating cylinder disposed outside said receiving/supporting cylinder, and rotatably engaged with said receiving/supporting cylinder;

a pin protrudingly disposed on one of an inner circumferential surface of said operating cylinder and an outer circumferential surface of said receiving/supporting cylinder;

a circumferential direction-wise extending guiding groove disposed on the other of said inner circumferential surface of said operating cylinder and said outer circumferential surface of said receiving/supporting cylinder; and a longitudinally extending ridge disposed on said inner circumferential surface of said operating cylinder, for forcedly pressing said distal end portion of said engaging piece toward said receiving/supporting cylinder when said pin is moved along said guiding groove from one end of said guiding groove to the other.

2. A device for adjusting height of an armrest for a chair, said device comprising:

an upright support for attachment to a seat;

a receiving/supporting cylinder for use in an armrest, longitudinally movably engaged with said support, with said support inside;

a longitudinally extending slit disposed on said receiving/supporting cylinder;

an engaging piece integrally disposed on said receiving/supporting cylinder at longitudinal direction-wise one end of said slit, and being elastically deformable inside said slit;

a longitudinal groove disposed on said support;

catching pieces disposed longitudinally in spaced-apart steps on a bottom wall of said groove, for catching a distal end portion of said engaging piece by stages;

an operating cylinder disposed outside said receiving/supporting cylinder, and rotatably engaged with said receiving/supporting cylinder;

a pin protrudingly disposed on one of an inner circumferential surface of said operating cylinder and an outer circumferential surface of said receiving/supporting cylinder;

a circumferential direction-wise extending guiding groove disposed on the other of said inner circumferential surface of said operating cylinder and said outer circumferential surface of said receiving/supporting cylinder; and a longitudinally extending ridge disposed on said inner circumferential surface of said operating cylinder, for contacting to said distal end portion of said engaging piece to thereby prevent said engaging piece from being elastically deformed in the direction away from said catching pieces when said pin is moved along said guiding groove from one end of said guiding groove to the other.

3. A device for adjusting the height of an armrest for a chair, said device comprising:

an upright support for attachment to a seat;

a receiving/supporting cylinder for use in an armrest, longitudinally movably engaged with said support, with said support inside;

a longitudinally entending slit disposed on said receiving/supporting cylinder;

an engaging piece integrally disposed on said receiving/supporting cylinder at longitudinal direction-wise one end of said slit, and being elastically deformable inside said slit to thereby swing;

a longitudinal groove disposed on said support;

catching pieces disposed longitudinally in spaced-apart steps on a bottom wall of said groove, for catching a distal end portion of said engaging piece;

an operating cylinder disposed outside said receiving/supporting cylinder, and rotatably engaged with said receiving/supporting cylinder;

a pin protrudingly disposed on one of an inner circumferential surface of said operating cylinder and an outer circumferential surface of said receiving/supporting cylinder;

a circumferential direction-wise extending guiding groove disposed on the other of said inner circumferential surface of said operating cylinder and said outer circumferential surface of said receiving/supporting cylinder, and a longitudinally extending ridge disposed on said inner circumferential surface of said operating cylinder, for forcedly pressing said distal end portion of said engaging piece toward said receiving/supporting cylinder when said pin is moved along said guiding groove from one end of said guiding groove to the other said lower portion of said receiving/supporting, cylinder being constructed by an elastically deformable cylinder piece which is provided with slits, each opening downward, arranged along the circumferential direction, an outer circumferential surface of a lower portion of said cylinder piece and an inner circumferential surface of a lower portion of said operating cylinder are provided with tapered edges which are complementary to each other, respectively, and said tapered edge of said operating cylinder is interface fit to said tapered edge of said cylinder piece when said pin is moved along said guiding groove from said one end to said other end which is located above said one end.

4. A device for adjusting height of an armrest for a chair, said device comprising:

an upright support for attachment to a seat;

a receiving/supporting cylinder for use in an armrest, longitudinally movably engaged with said support, with said support inside;

a longitudinally extending slit disposed on said receiving/supporting cylinder;

an engaging piece integrally disposed on said receiving/supporting cylinder at longitudinal direction-wise one end of said slit, and being elastically deformable inside said slit;

a longitudinal groove disposed on said support:

catching pieces disposed longitudinally in spaced-apart steps on a bottom wall of said groove, for catching a distal end portion of said engaging piece by stages;

an operating cylinder disposed outside said receiving/supporting cylinder, and rotatable engaged with said receiving/supporting cylinder;

a pin protrudingly disposed on one of an inner circumferential surface of said operating cylinder and an outer circumferential surface of said receiving/supporting cylinder;

a circumferential direction-wise extending guiding groove disposed on the other of said inner circumferential surface of said operating cylinder and said outer circumferential surface of said receiving/supporting cylinder; and a longitudinally extending ridge disposed on said inner circumferential surface of said operating cylinder, for contacting with said distal end portion of said engaging piece to thereby prevent said engaging piece from being elastically deformed in the direction away from said catching pieces when said pin is moved along said guiding groove from one end of said guiding groove to the other said lower portion of said receiving/supporting cylinder being constructed by an elastically deformable cylinder piece which is provided with slits, each opening downward, arranged along the circumferential direction, an outer circumferential surface of a lower portion of said cylinder piece and an inner circumferential surface of a lower portion of said operating cylinder are provided with tapered edges which are complimentary to each other, respectively, and said tapered edge of said operating cylinder is interface fit to said tapered edge of said cylinder piece when said pin is moved along said guiding groove from said one end to said other end which is located above said one end.

* * * * *